US011112716B2

(12) United States Patent
Sawamoto et al.

(10) Patent No.: US 11,112,716 B2
(45) Date of Patent: Sep. 7, 2021

(54) CARRIER CORE MATERIAL FOR ELECTROPHOTOGRAPHIC DEVELOPER AND METHOD FOR PRODUCING THE SAME, AND CARRIER FOR ELECTROPHOTOGRAPHIC DEVELOPER AND DEVELOPER CONTAINING SAID CARRIER CORE MATERIAL

(71) Applicant: POWDERTECH CO., LTD., Kashiwa (JP)

(72) Inventors: Hiroki Sawamoto, Kashiwa (JP); Atsushi Nil, Kashiwa (JP); Yuji Ito, Kashiwa (JP); Hajime Akiba, Kashiwa (JP); Shinya Hanyu, Kashiwa (JP)

(73) Assignee: POWDERTECH CO., LTD., Chiba (JP)

( * ) Notice: Subject to any disclaimer, the term of this patent is extended or adjusted under 35 U.S.C. 154(b) by 0 days.

(21) Appl. No.: 16/751,031

(22) Filed: Jan. 23, 2020

(65) Prior Publication Data

US 2020/0241435 A1 Jul. 30, 2020

(30) Foreign Application Priority Data

Jan. 25, 2019 (JP) ..... JP2019-011440

(51) Int. Cl.
*G03G 9/00* (2006.01)
*G03G 9/107* (2006.01)
*G03G 9/08* (2006.01)

(52) U.S. Cl.
CPC ..... *G03G 9/1075* (2013.01); *G03G 9/0808* (2013.01); *G03G 9/107* (2013.01); *G03G 9/1085* (2020.08)

(58) Field of Classification Search
CPC ..... G03G 9/1075; G03G 9/1085; G03G 9/107
USPC ..... 430/111.31, 111.4
See application file for complete search history.

(56) References Cited

U.S. PATENT DOCUMENTS

| | | | | |
|---|---|---|---|---|
| 2005/0064315 | A1 | 3/2005 | Yamaguchi et al. | |
| 2008/0241729 | A1 | 10/2008 | Kayamoto et al. | |
| 2010/0183968 | A1 | 7/2010 | Sugawara et al. | |
| 2010/0248125 | A1* | 9/2010 | Hikichi ..... | G03G 9/1136 430/111.1 |

FOREIGN PATENT DOCUMENTS

| | | | |
|---|---|---|---|
| EP | 2584410 | A1 | 4/2013 |
| EP | 2913715 | A1 | 9/2015 |
| JP | 2005250424 | A | 9/2005 |
| JP | 2008249855 | A | 10/2008 |
| JP | 2010164909 | A | 7/2010 |
| JP | 2010210951 | A | 9/2010 |

(Continued)

OTHER PUBLICATIONS

Extended European Search Report for related EP App. No. 20153489.8 dated May 19, 2020; 8 pages.

*Primary Examiner* — Mark A Chapman
(74) *Attorney, Agent, or Firm* — Procopio, Cory, Hargreaves & Savitch LLP

(57) ABSTRACT

The present invention relates to a carrier core material for electrophotographic developer, having a ferrite composition and having a supernatant transmittance of 85.0% or more, a method for producing the carrier core material, a carrier for electrophotographic developer, containing the carrier core material, and a developer containing the carrier.

21 Claims, 1 Drawing Sheet

(56) References Cited

FOREIGN PATENT DOCUMENTS

| | | | |
|---|---|---|---|
| JP | 2010224054 | A | 10/2010 |
| JP | 2013137455 | A | 7/2013 |
| JP | 2013137456 | A | 7/2013 |
| JP | 2017167311 | A | 9/2017 |
| WO | 2018181845 | A1 | 10/2018 |

* cited by examiner

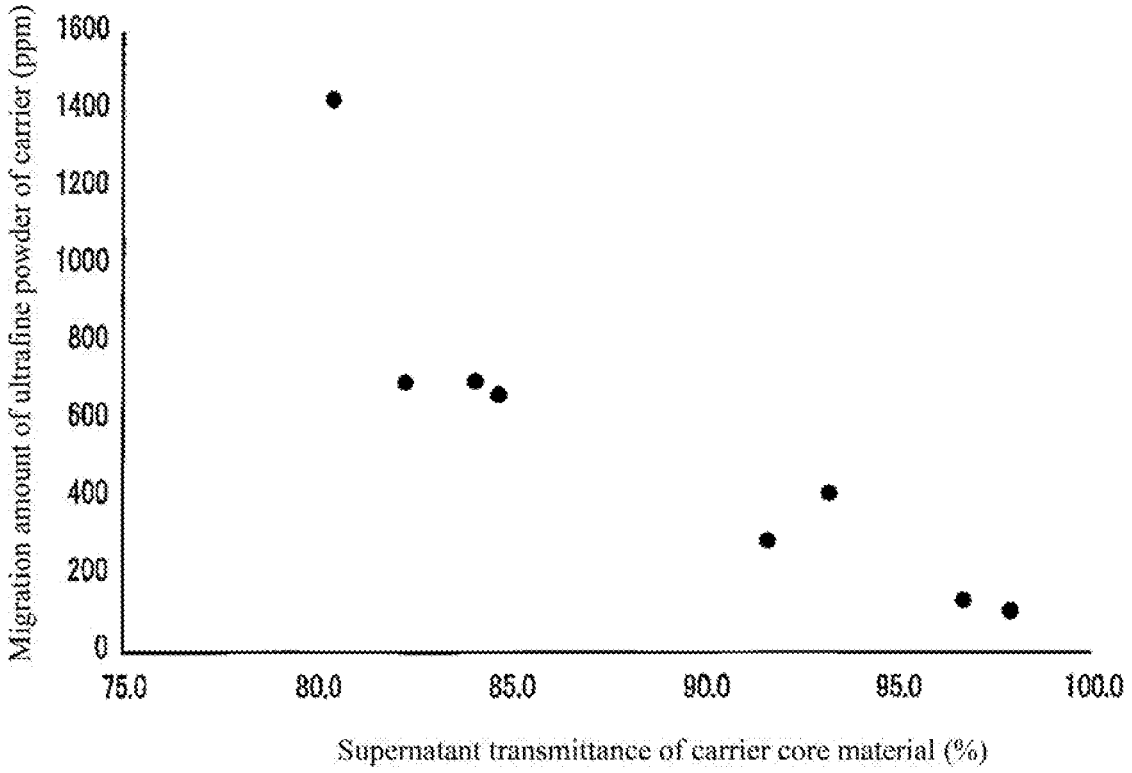
Migration amount of ultrafine powder of carrier (ppm)
1600
1400
1200
1000
800
600
400
200
0
75.0
80.0
85.0
90.0
95.0
100.0
Supernatant transmittance of carrier core material (%)

CARRIER CORE MATERIAL FOR ELECTROPHOTOGRAPHIC DEVELOPER AND METHOD FOR PRODUCING THE SAME, AND CARRIER FOR ELECTROPHOTOGRAPHIC DEVELOPER AND DEVELOPER CONTAINING SAID CARRIER CORE MATERIAL

TECHNICAL FIELD

The present invention relates to a carrier core material for electrophotographic developer and a method for producing the same, and also relates to a carrier for electrophotographic developer and a developer containing the carrier core material.

BACKGROUND

The electrophotographic development method is a method of transferring toner particles in a developer to electrostatic latent images formed on a photoreceptor to develop the images. The developer used in this method is classified into a two-component developer composed of toner particles and carrier particles, and a one-component developer using only toner particles. Among these, the two-component developer has a good controllability on designing a developer in comparison with a one-component developer. Therefore, the two-component developer is suitable for using in a full-color development apparatus requiring a high image quality or in a high-speed printing development apparatus requiring a reliability for maintain images and durability.

As a development method using the two-component developer, a cascade method and the like were formerly used, but a magnetic brush method using a magnet roll is now in the mainstream. In the magnetic brush, method, the carrier particles are stirred together with toner particles in a development box filled with a developer, and serve as carrier materials which impart the intended charge to the toner particles and further transport the charged toner particles to a surface of a photoreceptor by a development roll (magnet roll) to form a toner image on the photoreceptor. The carrier particles remaining on the development roll having a magnet are again returned from the development roll to the development box, mixed and stirred with fresh toner particles, and used repeatedly in a certain period.

As carrier particles constituting the two-component developer, an iron powder carrier having a magnetic property has been conventionally used. However, in order to respond to market demand, for example, high image quality, high durability or high reliability, a ferrite carrier which is lighter and highly resistive is now in the mainstream. As the ferrite carrier, in addition to a ferrite carrier composed of ferrite particles, various carriers, for example, a resin-coated ferrite carrier in which a ferrite particle is used as a carrier core material and a resin coating layer is provided on the surface of the ferrite particle, a resin-filled ferrite carrier in which a porous ferrite particle is used as a carrier core material and a resin is filled in pores of the porous ferrite particle, or a magnetic powder-dispersed carrier in which ferrate powder (magnetic powder) is dispersed in a resin, have been known.

In the meanwhile, as to the two-component developer, a phenomenon in which a carrier component is mixed into a toner, that is, toner color contamination has become a problem. In particular, when the toner color contamination occurs in a color toner, color tint of the toner becomes turbid so that image quality is degraded. On this point, it has been conventionally considered that the toner color contamination is caused by a conductive agent contained in the carrier. Namely, in many cases, a resin component such as a coating resin contained in the carrier contains a conductive agent for the purpose of adjusting electric resistance, and a black component such as carbon black is used as the conductive agent. It has been considered that during the mixing and stirring of a carrier with a toner, the black component such as carbon black is released from the carrier and migrates to the toner to cause the toner color contamination. Based on this standpoint, it has been conventionally proposed to attempt to improve the resin component or conductive agent contained in the carrier, in order to prevent the toner color contamination arising from the conductive agent.

For example, Patent Literature 1 discloses a ferrite carrier for electrophotographic developer in which a surface of a carrier core material composed of a ferrite particle is coated with a mixed resin prepared by dispersing a tetrafluoroethylene-fluoropropylene copolymer or tetrafluoroethylene-perfluoroalkyl vinyl ether copolymer and a polyamide imide resin in water as a dispersion medium, the coating resin formed from the mixed resin contains carbon black, and supernatant transmittance is 90% or more. It is described that according to the carrier, carbon black added in the resin coating layer as a conductive agent can be prevented from dropping off and thus, can be also prevented from color mixing with a toner, particularly a yellow toner (Claim 1 and [0094] of Patent Literature 1.

Furthermore, Patent Literature 2 discloses an electrostatic latent image developer containing a transparent toner for electrostatic latent image, and further containing a carrier containing a white conductive agent such as zinc oxide. It is described that the use of the white conductive agent makes a carrier fragment inconspicuous in a toner image when the carrier fragment is transferred to a transfer material ([10092] to [0095] of Patent Literature 2). These literature's focus on the conductive agent in the resin component contained in the carrier and intend to solve color contamination, and do not focus on a ferrite component constituting a carrier core material.

On the other hand, although the prevention of toner color contamination is not intended, it has been proposed to focus on a ferrite component contained in a carrier or a carrier core material to control a ratio of ferrite particles having small diameter. For example, Patent Literature 3 discloses that as to a carrier for electrophotographic developer, an amount of particles having a particle size of less than 20 μm is set to from 0 to 7% by weight and that in the case where the amount exceeds 7% by weight, carrier adhesion rapidly deteriorates (Claim 1 and [0022] of Patent Literature 3). Patent Literature 4 discloses that as to a ferrite carrier core material for electrophotographic developer, an amount of fine particles capable of passing through a mesh having an opening of 16 μm is set to 3% by weight or less and that a content of fine particles in the level of causing carrier scattering is decreased ([0026] of Patent Literature 4).

Furthermore, Patent Literature 5 discloses that as to a resin-coated ferrite carrier for electrophotographic developer, an amount of particles having a particle size of a ferrite carrier core material being 19.3 μm or less is set to 15% by number or less and that in the case where the amount exceeds 13% by number, carrier attraction is apt to occur ([0035] of Patent Literature 5). Patent Literature 6 discloses that as to a ferrite carrier core material for electrostatic latent image development, a content ratio of particles having an equivalent circle diameter of 15 μm or less and an aspect ratio of 1.5 or more is set to 1.0% by number and that according to this configuration, carrier scattering during development is prevented and generation of scratches on a photoreceptor or the like arising from the carrier is decreased and [0035] of Patent Literature 6).

PTL-1: JP-A-2010-224054
PTL-2: JP-A-2010-164909
PTL-3: JP-A-2005-250424
PTL-4: WO2018/181845
PTL-5: JP-A-2008-249855
PTL-6: JP-A-2010-210951

SUMMARY

As to as color toner, the occurrence of toner color contain contamination is considered as a problem, and it is proposed to focus on a resin component or conductive agent contained in a carrier to attempt to prevent the toner color contamination derived from the conductive agent, as disclosed in Patent Literatures 1 and 2. On the other hand, in recent years, a development apparatus using a special color, for example, white, clear, gold or silver in addition to color toners using conventional four primary color (black, cyan, yellow, and magenta) becomes popular so that the demand for color contamination becomes severe. Especially, as to a white toner or a clear toner (transparent toner), since only even slight color contamination is conspicuous, further prevention of color contamination has been required.

Conventional techniques have brought about a certain effect on a color toner of, for example, a yellow toner. However, as to a special color toner, particularly, a white toner or a clear toner, there is room for improvement. For example, Patent Literature 2 describes that since a white conductive agent is used, even when it migrates to a toner, the color contamination is inconspicuous. However, the color contamination as to a white toner or a clear toner cannot be completely prevented even in the case where such a white conductive agent is used.

The present inventors have investigated in detail color-contaminated toner after development in order to determine the cause of the occurrence of toner color contamination by a carrier. As a result, they ascertained that apart from a conductive agent, ferrite ultra fine powder of from a sub-micron level to a several μm level (also, referred to as ultrafine powder in some cases) is present on as toner. A carrier contains a carrier core material composed of a ferrite particle in addition to a resin component and the carrier core material forms the core. Therefor, the present inventors considered that the ferrite ultrafine powder on the toner is derived from the carrier core material (ferrite particle). As a result of further investigation, they assumed that a small amount of ferrite ultrafine powder adheres to a surface of the carrier core material (ferrite particle) and this ferrite ultrafine powder migrates to toner when the carrier is mixed and stirred with a toner.

Moreover, the present inventors investigated means for quantitating the ferrite ultrafine powder adhering to a surface of the carrier core material. As a result, they found that the amount of the ferrite ultrafine powder adhering to a surface of the carrier core material can be accurately evaluated by taking supernatant transmittance of the carrier core material as an indicator. In addition, they ascertained that migration of the ferrite ultrafine powder to a toner can be suppressed by restricting the supernatant transmittance of the carrier core material to a predetermined range and as a result, the toner color contamination arising from the ferrite ultrafine powder can be notably prevented.

The present invention is completed based on the above findings, and an object of the present invent on is to provide a carrier core material for electrophotographic developer which is capable of preventing toner color contamination arising from ferrite ultrafine powder and a production method therefor, and provide a carrier for electrophotographic developer and a developer containing the carrier core material.

The present invention includes aspects (1) to (15) described below. In the specification, the expression "to" for a range means a range including numerical values given before and after "to". That is, "X to Y" has the same meaning as "X or more and Y or less".

(1) A carrier core material for electrophotographic developer, having a ferrite composition and having a supernatant transmittance of 85.0% or more.
(2) The carrier core material as described in (1) above, in which the supernatant transmittance is 90.0% or more.
(3) The carrier core material as described in (1) or (2) above, having an apparent density of from 1.5 to 2.5 g/cm$^3$.
(4) The carrier core material as described in any one of (1) to (3) above, having a volume average particle diameter $D_{50}$ of from 20 to 50 μm.
(5) The carrier core material as described one of (1) to (4) above has a shape factor SF-1 of from 105 to 150.
(6) The carrier core material as described in any one of (1) to (above having a BET specific surface area of from 0.05 to 055 m$^2$/g.
(7) The carrier core material as described in any one of (1) to (6) above, having art average equivalent circle diameter of from 20 to 50 μm.
(8) The carrier core material as described in any one of (1) to (7) above, in which the ferrite composition is represented by formula (1): $(MO)_x(Fe_2O_3)_y$ (here, x+y is 100% by mole, y is 30 to 95% by mole, and M is at least one element selected on the group consisting of Fe, Mn, Mg, Sr, Ca, Ti, Li, Al, Si, Zr, and Bi).
(9) A method tor producing the carrier core material as described in any one of (1) to (8) above, containing steps described below:
mixing and pulverizing raw materials of the carrier core material to form a raw material mixture,
calcining the raw material mixture to form a calcined product,
pulverizing and granulating the calcined product to form a granulated product,
sintering the granulated product to form a sintered product, and
removing ultrafine powder from the sintered product.
(10) The method as described in (9) above, in which in the step of removing ultrafine powder, the sintered product is mixed to and dispersed in a solvent to from a slurry, the slurry is allowed to stand to separate into a precipitate and a supernatant liquid, and after removing the supernatant liquid, the precipitate is recovered and dried.
(11) A carrier for electrophotographic developer, containing the carrier core material as described in any one of (1) to (8) above.
(12) The carrier as described in (11) above, further containing a resin coating layer provided on a surface of the carrier core material.
(13) The carrier as described in (11) or (12) above, in which the carrier core material is composed of porous ferrite particles having pores, and the carrier further contains a resin filled in the pores.

(14) A developer containing the carrier as described in any one of (11) to (13) above and a toner.

(15) The developer as described in (14), in which the toner is a white toner or a clear toner.

According to the present invention, the toner color contamination arising from ferrite ultrafine powder can be prevented. In particular, the excellent effect is obtained in the prevention of the color contamination on a special color toner, for example, a white toner or a clear toner.

BRIEF DESCRIPTION OF DRAWINGS

FIG. 1 is a graph showing a relationship between the supernatant transmittance of a carrier core material and a migration amount of ultrafine powder of a carrier.

EMBODIMENTS

Carrier Core Material for Electrophotographic Developer:

The carrier core material for electrophotographic developer (also, referred to as a carrier core material in some cases) of the present invention has a ferrite composition and has a supernatant transmittance of 85.0% or more. Here, the carrier core material is a material to serve as a core of a carrier, and a resin-coated carrier or a resin-filled carrier can be formed by coating or filling a rein to the core material. Alternatively, it is possible to use the carrier core material per se as a carrier without performing the coating or filling of a resin.

The carrier core material of the present invention has a supernatant transmittance of 85.0% or more. In the case where the supernatant transmittance is restricted to 85.0% or more, migration of the ferrite ultrafine powder to a toner can be notably suppressed and as a result, the toner color contamination arising from the ferrite ultrafine powder can be prevented. The supernatant transmittance is preferably 90% or more, and more preferably 95% or more. The greater supernatant transmittance value is more preferable, and the upper limit of the supernatant transmittance is not limited. The supernatant transmittance is typically 100% or less, and more typically 99.0% or less.

The supernatant transmittance is an optical transmittance at a wavelength of 400 nm of a supernatant liquid obtained from a suspension of the carrier core material and a solvent. The supernatant transmittance can be measured, for example, in the following manner. First, into a glass bottle are put 15 g of a carrier core material and 25 g of methanol, followed by stirring for 20 minutes at a shaking strength of 200 times/minute by using a shaker. After allowed to stand for one minute, a supernatant liquid is recovered. Then, an absorption spectrum of the supernatant liquid recovered is determined by using a spectrophotometer and the transmittance at a wavelength of 400 nm is measured to obtain the supernatant transmittance. Here, a forced precipitation means, for example, a magnet is not used when the supernatant liquid is obtained. Therefore, if ferrite ultrafine powder of from a submicron level to a several μm level is present, the ferrite ultrafine powder disperses and floats in the supernatant liquid to decrease the optical transmittance.

When the supernatant transmittance is taken as an indicator, the amount of the ferrite ultrafine powder can be accurately evaluated even in the case where the amount is small. This is because even in the ease where the amount of the ferrite ultrafine powder in the supernatant liquid is small, its influence remarkably appears in the optical transmittance. In fact, in the case of using the supernatant transmittance as an indicator, a migration amount of the ferrite ultrafine powder to a toner can be controlled from a several tens of ppm level to a several thousands of ppm level. On the contrary, in particle size distribution measurement methods utilizing a laser diffraction/scattering method, a screen or the like as disclosed in Patent Literatures 3 to 6, it is difficult to accurately evaluate the amount of the ferrite ultrafine powder.

The carrier core material of the present invention has a ferrite composition. Namely, the carrier core material is composed of ferrite particles. Here, the terms "has a ferrite composition" means that the content of ferrite component in the carrier core material is 50% by weight or more. The content of ferrite component is preferably 80% by weight or more, and more preferably 90% by weight or more. In the case where the content of ferrite component is 50% by weight or more, excellent characteristics of carrier core material based on ferrite, for example, high magnetization, high resistance or lightweight can be sufficiently exerted. The upper limit of the content is not particularly limited and the content is typically 100% by weight or less.

The ferrite composition is not particularly limited as long as it functions as a carrier core material and a conventionally known composition may be used. However, the ferrite preferably has a composition represented by formula (1): $(MO)_x(Fe_2O_3)_y$. Here, x+y is 100% by mole, and y is 30 to 95% by mole. M is one or two or more elements selected from the group consisting of Fe, Mn, Mg, Sr, Ca, Ti, Li, Al, Si, Zr, and Bi. According to such a composition, the characteristics of carrier core material based on ferrite can be sufficiently exerted. On the other hand, in consideration of the recent trend of environmental load reduction including the waste regulation, it is desired that the ferrite composition does not contain heavy metals such as Cu, Zn and Ni in a content exceeding an inevitable impurity (associated impurity) range.

The apparent density (AD) of the carrier core material is preferably from 1.5 to 2.5 g/cm$^3$. In the case where the apparent density is 1.5 g/cm$^3$ or more, the fluidity of the carrier is sufficiently improved. Furthermore, in the case where the apparent density is 2.5 g/cm$^3$ or less, the effect of suppressing deterioration of charging characteristics caused by stirring stress in a developing machine is sufficiently exerted. The apparent density is more preferably from 1.6 to 2.45 g/cm$^3$, and still more preferably from 1.7 to 2.4 g/cm$^3$. In addition, the ferrite particle constituting the carrier core material may be a particle having no open pores (fine pores) on its surface or may be a porous particle having open pores (fine pores).

The volume average particle size ($D_{50}$) of the carrier core material is preferably from 20 to 50 μm. In the case where the volume average particle size is 20 μm or more, carrier scattering is sufficiently suppressed. Furthermore, in the case where the volume average particle size is 50 μm or less, image quality is more improved. The volume average particle size is more preferably from 25 to 45 μm, and still more preferably from 30 to 40 μm.

The shape factor SF-1 of the carrier core material is preferably from 105 to 150. The shape factor SE-1 serves as an indicator of sphericity, and it is 100 in a perfect spherical form and increases as deviating from the perfect spherical form, in the case where the shape factor SE-1 is 105 or more, moderate unevenness can be provided on a surface of the carrier core material and as a result, when a carrier is formed, adhesion between the carrier core material and a coating resin is more improved. Furthermore, in the case where the shape factor is 150 or less, excessive deterioration in the shape is suppressed so that the occurrence of image defect, for example, white spots due to scratches on a photoreceptor can be sufficiently prevented. The shape factor SF-1 is more preferably from 110 to 140, and still more preferably from 115 to 130.

The BET specific surface area of the carrier core material is preferably from 0.05 to 0.55 $m^2/g$. In the case where the BET specific surface area is 0.05 $m^2/g$ or more, an effective charging area becomes large so that the charge-imparting ability is, sufficiently improved. Furthermore, in the case where the BET specific surface area is 0.55 $m^2/g$ or less, the compression breaking stress sufficiently increases. The BET specific surface area is more preferably from 0.05 to 0.45 $m^2/g$, and still more preferably from 0.06 to 0.35 $m^2/g$.

The average equivalent circle diameter of the carrier core material is preferably from 20 to 50 μm. As means for suppressing migration of carrier particles to a photoreceptor, it is effective to control the particle diameter of carrier. The particle diameter of carrier is greatly influenced by the particle diameter of the carrier core material. In the case where the average equivalent circle diameter of the carrier core material is 20 μm or more, the migration of carrier particles to a photoreceptor can be sufficiently suppressed. Furthermore, in the ease where the average equivalent circle diameter of the carrier core material is 50 μm or less, the effect of improving image quality becomes notable. The average equivalent circle diameter is more preferably from 25 to 45 μm, and still more preferably from 30 to 40 μm.

The carrier core material may be provided with an oxide film covering a surface of the ferrite particle. The oxide film may be formed uniformly on the surface of the ferrite particle or may be partially termed. The oxide film can be formed by performing a surface oxidation treatment to a ferrite particle. The carrier core material having an oxide film on its surface has not only an improved electric resistance but also uniform distribution of the electric resistance. Accordingly, the occurrence of carrier scattering is more reliably suppressed. The thickness of the oxide film is preferably from 0.1 nm to 5 μm. In the case where the thickness is 0.1 nm or more, the effect of the oxide film can be sufficiently exerted. Furthermore, in the case where the thickness is 5 μm or less, decrease in magnetization and excessive increase in resistance can be sufficiently suppressed.

The carrier core material of the present invention is characterized by restricting the supernatant transmittance to 85.0% or more. Owing to this, migration of the ferrite ultrafine powder to a toner is notably suppressed and as a result, the toner color contamination is prevented. This effect is particularly effective for a special color toner such as a white toner or a clear toner. The ferrite contains a transition metal oxide such as iron oxide ($Fe_2O_3$) or manganese oxide (MnO) as a main component and has a color tone of deep color such as dark brown to black. Therefore, when even a small amount of the ferrite ultrafine powder of deep color migrates to a white toner or a clear toner, it leads to a color contamination. On this point, the earner core material of the present invention can reduce a migration amount of the ferrite ultrafine powder so that the color contamination of white color toner or clear toner can be prevented.

On the contrary, a carrier core material has conventionally not been considered as a cause of the toner color contamination. Therefore, no technique has been known prior to the present invention, which focuses on even a carrier core material, much less the ferrite ultrafine powder adhering to a surface of the carrier core material, from a standpoint of preventing toner color contamination. Moreover, no means for accurately evaluating and controlling the amount of ferrite ultrafine powder have been known. This is because the ferrite ultrafine powder on a surface of the carrier core material has a small particle diameter of from a submicron level to a several μm level and the amount thereof is also small.

In the meanwhile, in Patent Literature 1, the supernatant transmittance of a ferrite carrier is restricted to 90% or more (Claim 1 of Patent Literature 1). However, the supernatant transmittance disclosed in Patent Literature 1 is a supernatant transmittance of a resin-coated carrier and not that of a carrier core material. Therefore, the amount of the ferrite ultrafine powder of the carrier core material cannot be evaluated by the supernatant transmittance disclosed in Patent Literature 1. In fact, in Patent Literature 1, when the supernatant transmittance is measured, a magnet is placed on a bottom of a sample bottle to forcibly sink the carrier ([0046] of Patent Literature 1). According to this technique, even if ferrite ultrafine powder is present, it is attracted to the magnet to be precipitated. Accordingly, an accurate amount of ferrite ultrafine powder is not reflected in the supernatant transmittance.

Furthermore, in Patent Literatures 3 to 6, a ratio of particles having a small diameter in a carrier or carrier core material is controlled from the standpoint of preventing carrier scattering. However, these literatures are not focused on the prevention of the toner color contamination. In addition, the techniques disclosed in these literatures cannot sufficiently achieve the prevention of the toner color contamination due to ferrite ultrafine powder.

For example, Patent Literature 3 describes that in the case where the amount of particles having a particle size of less than 20 μm exceeds 7% by weight, carrier adhesion rapidly deteriorates. But on the other hand, Patent Literature 3 also describes that a content ratio of the particles having a particle size of less than 20 μm is preferably 0.5% by weight or more and that in the case where the content ratio is 0.5% by weight or more, the desired value can be obtained without incurring costs ([0022] and [0023] of Patent Literature 3). As described above, Patent Literature 3 does not necessarily intend only to decrease the amount of particles having a small particle diameter and even more, it does not focus on the amount of ferrite ultra powder from the standpoint of preventing the toner color contamination.

Furthermore, in Patent Literature 3, the carrier core material is classified by using a vibration screen machine equipped with an ultrasonic wave oscillator and a particle size distribution is measured by using a Microtrack particle size analyzer ([0027] and [0029] of Patent Literature 3). However, it is difficult to effectively remove ferrite ultrafine powder by the vibration screen machine. Furthermore, based on the measurement principle, the Microtrack particle size analyzer cannot accurately evaluate the amount of ferrite ultrafine powder of from a submicron level to a several μm level leading to the toner color contamination. That is, the Microtrack particle size analyzer measures a particle diameter of particles by utilizing a laser diffraction/scattering method. Therefore, ultrafine powder hide behind a large-diameter particle cannot be recognized. Also, ultrafine powder adhering to a surface of a carrier core material cannot be detected. Therefore, the technique, disclosed in Patent Literature 3 is insufficient to prevent the color contamination while a certain effect is obtained in view of preventing carrier scattering.

Method for Producing Carrier Core Material for Electrophotographic Developer:

The method for producing a carrier core material of the present invention contains at least steps described below:

mixing and pulverizing raw materials of the carrier core material to form a raw material mixture; calcining the raw material mixture to form a calcined product; pulverizing and granulating the calcined product to form a granulated product; sintering the granulated product to form a sintered product; and removing ultrafine powder from the sintered product. The production method is particularly characterized by containing the step of removing ultrafine powder from the sintered product (ultrafine powder-removing step). Owing to this step, ferrite ultrafine powder leading to the toner color contamination is effectively removed. Each of the steps will be described in detail below.

Mix and Pulverization of Raw Materials:

In the mixing and pulverizing step of raw materials, raw materials of the carrier core material are mixed and pulverized to from a raw material mixture. The raw materials are not limited as long as a desired ferrite composition can be obtained and, for example, oxides, carbonates, hydroxides and/or chlorides can be used. The raw materials include, for example. $Fe_2O_3$, $Fe_3O_4$, $MnO_2$, $Mn_2O_3$, $Mn_3O_4$, $MnCO_3$, MgO, $Mg(OH)_2$, $MgCO_3$, $SrCO_3$, $CaCo_3$, $TiO_2$, $Li_2CO_3$, $Al_2O_3$, $SiO_2$, $ZrO_2$, $Bi_2O_3$, and the like.

The raw materials are weighed, mixed and pulverized. A method of mixing and pulverizing is not particularly limited and a known technique may be used. For example, the mixing and pulverizing can be performed by either or both of a dry process and a wet process by using a pulverizer such as a vibration mill, a ball mill or a beads mill. The time for mixing and pulverizing is preferably 0.5 hours or more, and more preferably from one to 20 hours.

Calcination:

In the calcination step, the resulting raw material mixture is calcined to form a calcined product. The conditions of calcination are not particularly limited and known conditions may be used. For example, the calcination may be performed at a temperature from 700 to 1,300° C. for from 0.5 to 10 hours under atmospheric conditions. Furthermore, if desired, the raw material mixture may be granulated before the calcination. The granulation method includes, for example, a technique of pelletizing by using a pressure molding machine such as a roller compactor and a technique of adding water to the raw material mixture to form a slurry and granulating the slurry by using a spray dryer.

Pulverization and Granulation:

In the pulverizing and granulating step, the calcined product is pulverized and granulated to form a granulated product. The pulverization method is nut particularly limited and a known technique may be used. For example, the pulverization may be performed by either or both of a dry process and a wet process by using a pulverizer such as a vibration mill, a ball mill or a beads mill. The granulation method is also not particularly limited and a known technique may be used. For example, water and, if desired, a dispersant or a binder such as polyvinyl alcohol (PVA) may be added to the calcined product after pulverization to adjust viscosity and then, the granulation may be performed by using a granulator such as a spray dryer. Furthermore, in the case where an organic substance such as a binder is added at the time of granulation, the organic substance may be removed by performing a heat treatment after the granulation. The temperature of the heat treatment may be determined depending on the kind of organic substance and may be, for example, from 500 to 900° C.

Sintering:

In the sintering step, the granulated product is sintered to form a sintered product. The conditions of sintering are not particularly limited and known conditions may be used. For example, the sintering may be performed under conditions of holding the granulated product at a temperature from 800 to 1,500° C. for from 1 to 24 hours in an atmosphere having an oxygen concentration of from 0.1 to 5.0% by volume. In the sintering, a known furnace such as a rotary electric furnace, a batch electric furnace or a tunnel electric furnace can be used. Furthermore, during the sintering, the oxygen concentration in the furnace may be controlled by introducing an inert gas such as nitrogen gas or a reducing gas such as hydrogen gas or carbon monoxide gas.

If desired, the resulting sintered product may be disaggregated and thereafter classified to remove coarse particles or fine particles. The disaggregation may be performed by using a known crushing machine such as a hummer crusher. The classification may also be performed by using a known technique. For example, coarse particles may be removed by using a vibration screen machine equipped with a screen mesh of from 100 to 500 mesh and then fine particles may be removed by using a precision air classifier under low speed conditions. The classification conditions of fine particles may be determined depending on specification such as a type or a size of the classifier and are not particularly limited. For example, in the case of using a precision air classifier (Turbo Classifier TC-15, manufactured Nissin Engineering Inc.), a rotational speed of the classifier may be set from 700 to 2,000 rpm. Furthermore, after the classification, low magnetic products may be classified and removed by a magnetic separation.

Removal of Ultra Fine Powder:

The production method of the invention is characterized by containing the step of removing ultrafine powder. In the step of removing ultrafine powder, ferrite ultrafine powder is removed, from the resulting sintered product (including a sintered product disaggregated anti or classified after the sintering) to form a carrier core material. A technique for the removal of ultrafine powder is not limited as long as the supernatant transmittance of the carrier core material obtained is 85% or more. The removal of ultrafine powder may be performed in either of a dry process and a wet process. However, it is preferred to perform in a wet process. This is because, in the case of a wet process, due to the repellent force of electric double layer, ultrafine powder released from a carrier core material can be effectively prevented from re-adhering. In addition, as to the ultrafine powder (ferrite ultrafine powder), the particle diameter thereof is distributed in a range of from a submicron level to a several μm level, and typically in a range of from 10 nm to 10 μm.

The removal of ultrafine powder by a wet process can be performed in the manner described below. First, the sintered product is mixed with and dispersed in a solvent by using a mixer to from a slurry. During the mixing and dispersing, the ultrafine powder is released from the sintered product (carrier core material) to be dispersed in the slurry. The solvent is not particularly limited and examples thereof include glycols such as propylene glycol or ethylene glycol. This is because, in the vase of using a glycol, not only the ultrafine powder is sufficiently dispersed but also classification efficiency increases in the subsequent sedimentation and classification due to the high viscosity of the slurry. In addition, from the standpoint of accelerating the release of ultrafine powder, a high-speed mixer such as a thin-film spin system high-speed mixer is preferably used in the dispersion treatment. In the case of using the high-speed mixer, the dispersion treatment is preferably performed under conditions at a rotational speed of from 10 to 100 m/second for 0.1 to 10 minutes. In the case where the dispersion treatment is performed under such high speed conditions, the release and dispersion of ultrafine powder adhering to a surface of the sintered product into the slurry can be effectively performed.

Next, the slurry is allowed to stand to separate into a precipitate and a supernatant liquid. During the standing, the sintered product (carrier core material) having a large diameter rapidly sinks because of its large mass and forms a precipitate. On the contrary, the ultrafine powder having a small diameter, released from the sintered product is hard to sink because of its small mass and disperses and floats in the supernatant liquid. Therefore, the ultrafine powder can be effectively removed by removing the supernatant liquid. The time for which the slurry is allowed to stand can be appropriately adjusted depending on the solvent used and is preferably from 10 seconds to 60 minutes. In the case where the standing time is 10 seconds or more, the sintered product can be sufficiently precipitated. In the case where the standing time is 60 minutes or less, the ultrafine powder can be sufficiently prevented from precipitating and being remixed into the sintered product. After removing the supernatant liquid, the precipitate is recovered and dried, thereby obtaining a sintered product (carrier core material) from which ultrafine powder has been removed.

On the other hand, the removal of ultrafine powder by a dry process is preferably performed under high speed conditions using a precision air classifier which is able to realize submicron classification. In a precision air classifier, powder supplied from a raw material-charging port is uniformly dispersed by a dispersion blade and a dispersion plate in the state of riding an air current and then sent to a classification chamber. In the classification chamber, the powder receives centrifugal force due to rotation flow, and also receives drag force of opposing air flow. Due to the balance between the centrifugal force and the drag force, coarse particles and fine particles in the powder are classified. In the present invention, as the rotational speed of classifier increases, dispersion of the sintered product proceeds. That is, when the rotational speed increases, a larger impact force is applied to the sintered product during the dispersion and a shear strength applied to particle on a rotating rotor increases. Therefore, the release of ultrafine powder adhering to a surface of the sintered product is accelerated so that the ultrafine powder is easily classified and removed.

The classification conditions may be determined depending on specification of the classifier, such as a type or a size, and are not particularly limited. For example, in the case of using a precision air classifier (Turbo Classifier TC-15, manufactured by Nissin Engineering Inc.), a rotational speed of the classifier is preferably 2,000 rpm or more. In the case of less than 2,000 rpm, the ultrafine powder cannot be effectively classified and removed from the sintered product. The rotational speed is more preferably 4,000 rpm or more, and further preferably 6,000 rpm or more. The upper limit of the rotational speed is not particularly limited and the rotational speed is typically 11,000 rpm or less.

According to the production method of the present invention, a carrier core material in which the amount of ferrite ultrafine powder is sufficiently low can be obtained by a technique of removing the ferrite ultrafine powder from the sintered product, in particular, by a technique of high, dispersion of a slurry and removal of a supernatant liquid or by a technique of classification operation by a precision air classifier under high speed conditions.

Formation of Oxide Film:

If desired, the sintered product (carrier core material) from which ultrafine powder has been removed may be heated at a low temperature to form an oxide film on the surface thereof. The electric resistance, of the carrier core material can be adjusted by forming the oxide film. A method for forming the oxide film is not particularly limited and a known method may be used. For example, the sintered product (carrier core material) may be subjected to a heat treatment at a temperature from 300 to 700° C. by using a furnace such as a rotary electric furnace or a hatch electric furnace. The thickness of oxide film can be adjusted by controlling the heat treatment temperature and retention time.

Carrier for Electrophotographic Developer:

The carrier for electrophotographic developer (also referred to as a carrier in some cases) of the present invention is not particularly limited as long as it contains the carrier core material described above. For example, the carrier may be a resin-coated carrier that is a carrier having a resin-coating layer on a surface of the carrier core material (ferrite particle) or a resin-filled carrier that is a carrier in which a carrier core material is composed of a porous ferrite carrier having pores (voids) and a resin (filling resin) filled in the pores. Alternatively, the carrier core material per se may be used as a carrier without using a resin.

The resin-coated carrier has advantages in that carrier characteristics can be precisely controlled and also toner spent can be prevented. The carrier characteristics may be affected by materials present on the surface of carrier and properties thereof. Therefore, desired charrier characteristics can be precisely imparted by surface-coating with an appropriate resin. Furthermore, the resin-coating layer reduces opportunities where ferrite particles constituting the carrier core material are brought into directly contact with a toner. Therefore, a phenomenon in which a toner adheres to a carrier, so-called toner spent, can be prevented.

The kind of the coating resin is not particularly limited. Examples of the coating resin include a fluorine resin, an acrylic resin, an epoxy resin, a polyamide resin, a polyamide imide resin, a polyester resin, an unsaturated polyester resin, a urea resin, a melamine resin, an alkyd, resin, a phenol resin, a fluoroacrylic resin, an acryl-styrene resin, a silicone resin, and a modified silicone resin modified with a resin such as an acrylic resin, a polyester resin, an epoxy resin, a polyamide resin, a polyamide imide resin, an alkyd resin, a urethane resin, or a fluorine resin. In consideration of release of the resin due to the mechanical stress during usage, a thermosetting resin is preferably used. Specific examples of the thermosetting resin include an epoxy resin, a phenol resin, a silicone resin, an unsaturated polyester resin, a urea resin, a melamine resin, an alkyd resin, and resins containing them. The coating amount of the resin is preferably from 0.5 to 10.0 parts by weight with respect to 100 parts by weight of the carrier core material (before resin coating).

As the coating resin, a mixed resin prepared by dispersing a tetrafluoroethylene-hexafluoropropylene copolymer or a tetrafluoroethylene-perfluoroalkyl vinyl ether copolymer and a polyamide imide resin in water is particularly preferred. In the case of using this mixed resin, even in the case where the resin-coating layer contains carbon black as a conductive agent, the release of the carbon black can be effectively prevented.

Furthermore, the coating resin may contain a charge-controlling agent. Examples of the charge controlling agent include various types of charge-controlling agents commonly used for toner, and various types of silane coupling agents. The kinds of the charge-controlling agents and the coupling agents usable are not particularly limited, and a charge-controlling agent such as a nigrosine dye, a quaternary ammonium salt, an organic metal complex, and a metal-containing monoazo dye, an aminosilane-coupling agent, a fluorine-based silane-coupling agent, and the like are preferred.

Moreover, for the purpose of controlling the carrier characteristics, a conductive agent may be added to the coating resin in addition to the charge-controlling agent described above. The addition amount of the conductive agent is preferably from 0.25 to 20.0% by weight, more preferably from 0.5 to 15.0% by weight, and still more preferably from 1.0 to 10.0% by weight, with respect to the solid content of the coating resin. Examples of the conductive agent include, conductive carbons such as carbon black, oxides such as tin oxide or titanium oxide, and various types of organic conductive agents.

On the other hand, the resin-filled carrier has advantages of excellent durability because it has a low specific gravity and, a high strength. Because of its low specific gravity, the resin-filled carrier receives a small stress generated during stirring in a developing machine and thus, cracking or chipping of the carrier is less to occur and also toner spent can be reduced even used for a long period of time.

The kind of the filling resin is not particularly limited and may be appropriately selected according to a toner to be combined, usage environment or the like. Examples of the filling resin include a fluorine resin, an acrylic resin, an epoxy resin, a polyamide resin, a polyamide imide resin, a polyester resin, an unsaturated polyester resin, a urea resin, a melamine resin, an alkyd resin, a phenol resin, a fluoro-acrylic resin, an acryl-styrene resin, a silicone resin, and a modified silicone resin modified with a resin such as an acrylic resin, a polyester resin, an epoxy resin, a polyamide resin, a polyamide imide resin, an alkyd resin, a urethane resin, or a fluorine resin. In consideration of release of the resin due to the mechanical stress during usage, a thermosetting resin is preferably used. Specific examples of the thermosetting resin include an epoxy resin, a phenol resin, a silicone resin, an unsaturated polyester resin, a urea resin, a melamine resin, an alkyd resin, and resins containing them.

The filling amount of the resin is preferably from 2 to 20 parts by weight, more preferably from 2.5 to 15 parts by weight, and still more preferably from 3 to 10 parts by weight, with respect to 100 parts by weight of the carrier core material. In the case where the filling amount of the resin is 2 parts by weight or more, filling becomes sufficient and it becomes easy to control the charging amount by the resin coating. In the ease where the filling amount of the resin is 20 parts by weight or less, the generation of aggregated particles during the filling which may cause charge fluctuation can be sufficiently suppressed. Moreover, for the purpose of controlling the carrier characteristics, a conductive agent or a charge-controlling agent can be added to the filling resin. The kinds and amounts of the conductive agent and charge-controlling agent are the same as those in the coating resin. After a resin is filled in the pores of the carrier core material, the carrier core material may be further coated by a resin or not.

Developer:

The developer of the present Invention contains the carrier for electrophotographic developer described above and a toner. The toner constituting the developer includes pulverized toner particles produced by a pulverizing method and polymerized toner particles produced by a polymerization method. Any of the toner particles may be used. The average particle diameter of the toner particles is preferably from 2 to 15 μm, and more preferably from 3 to 10 μm. In the case where the average particle diameter is 2 μm or more, the charging ability is more improved and fogging and toner scattering are further suppressed. Furthermore, in the ease where the average particle diameter is 15 μm or less, the image quality is further improved. The mixing ratio of the carrier and the toner, that is, the toner concentration is preferably set from 3 to 15% by weight. In the case where the toner concentration is 3% by weight or more, a desired image density can be easily obtained. In the case where the toner concentration is 15% by weight or less, toner scattering and fogging are further suppressed. On the other band, in the case where the developer is used as a replenishment developer, the mixing ratio of the carrier and the toner may be set to from 2 to 50 parts by weight of the toner with respect to one part by weight of the carrier.

The toner may have any color tone and conventional toners of four primary colors (black toner, cyan toner, yellow toner end or magenta toner) may be used. However, special color toners (white toner, clear toner, gold toner, silver toner, and the like) are preferred and among these, white toner and clear toner are particularly preferred. The developer of the present invention can suppress migration of ferrite ultrafine powder to the toner and thus, it exhibits remarkable effect of the prevention of color contamination on white toner or clear tone in which only slight color contamination is conspicuous.

The developer of the present invention can be used in a copying machine, a printer, a FAX machine, a printing machine, and the like, which use a digital system employing a development system in which an electrostatic latent image formed on a latent image bolder having an organic photoconductive layer is reversely developed with a magnetic brush of a two-component developer containing a toner and a carrier while applying a bias electric field. Furthermore, the developer is also applicable to a full-color machine and the like using an alternative electric field, which is, a method in which when applying a development bias from a magnetic brush to an electrostatic latent image side, an AC bias is superimposed on a DC bias.

EXAMPLE

The present invention will be described more specifically with reference to Examples below.

Example 1

(1) Production of Carrier Core Material

Mix and Pulverization of Raw Materials:

Raw materials were weighed so as to attain a composition ratio after sintering of 38.0% by mole of MnO, 11.1% by mole of MgO, 50.3% by mole of $Fe_2O_3$, and 0.7% by mole of SrO. At that time, as the raw materials, 80.5 kg of iron oxide ($Fe_2O_3$), 29.0 kg of trimanganese tetraoxide ($Mn_3O_3$) 6.4 kg of magnesium hydroxide ($Mg(OH)_2$), and 1.0 kg of strontium carbonate ($SriCO_3$) were used. Next, the raw materials weighed were mixed, and pulverized for 5 hours by using a dry media mill (vibration mill, ⅛ inch diameter stainless steel beads), to prepare a raw material mixture.

Calcination:

The resulting raw material mixture was calcined. First, the raw material mixture was made into pellets of about 1 mm-cube by using a roller compactor. From the resulting pellets, coarse particles were removed by using a vibration screen having an opening of 3 mm and then fine particles were removed by using a vibration screen having an opening, of 0.5 mm. The pellets after removing the coarse particles and the fine particles, were heated at 1,100° C. for 3 hours by using a rotary electric furnace, to prepare a calcined product.

Pulverization and Granulation:

The resulting calcined product was pulverized by using a dry media mill (vibration mill, ⅛ inch diameter stainless steel beads), water was added thereto, and further pulverized for 5 hours by using a wet media, mill (vertical bead mill, 1/16 inch diameter stainless steel beads), to form a slurry. To the resulting slurry was added polyvinyl alcohol (PVA, 20% by weight solution) as a binder in an amount of 0.2% by weight with respect to the calcined product, and thereto was further added a polycarboxylic acid dispersant to adjust a slurry viscosity to 2 poise.

Next, the slurry after adjusting the viscosity was granulated and dried by using a spray drier. At that time, the conditions were set so as to attain an average particle size of the sintered product after sintering being 35 μm. The resulting granulated product was heated at 700° C. 2 hours by using a rotary electric furnace under atmospheric conditions to remove organic components such as the dispersant and the binder.

Sintering:

The granulated product after removing the organic components was sintered by using a tunnel electric furnace to prepare a sintered product. The sintering was performed by holding the granulated product at a sintering temperature of 1,260° C. for 5 hours in an atmosphere having an oxygen concentration of 2.0% by volume. The temperature rising rate was set to 150° C./hour and the temperature drop rate was set to 110° C./hour. Furthermore, nitrogen gas, was introduced to the electric furnace from its outlet side, and the internal pressure of the electric furnace was set to from 0 to 10 Pa (positive pressure). The resulting sintered product was disaggregated by using a hammer crusher and then, coarse particles were removed by using a gyro shifter equipped with a screen mesh of 350 mesh. The slavered product after removing coarse particles was subjected to a particle size adjustment of removing fine particles by using a precision air classifier (Turbo Classifier TC-15, manufactured by Nissin Engineering Inc.) under conditions of 1,200 rpm. Thereafter, low magnetic force products were removed by magnetic separation from the sintered product after the particle size adjustment, to obtain ferrite particles.

Removal of Ultrafine Powder:

Ultrafine powder was further removed from the ferrite particles (sintered product) after removing low magnetic force products. First, the ferrite particles were mixed with propylene glycol to prepare a slurry of ferrite particle having a solid content concentration of 30% by weight. Next, the resulting slurry was subjected to a dispersion treatment. The dispersion treatment was performed for one minute by using a thin-film spin system high-speed mixer (FILMIX, manufactured by PRIMIX Corp.) under conditions, of 50 in/second. The slurry after the dispersion treatment was allowed to stand for one minute to separate into a precipitate and a supernatant liquid. After removing the supernatant liquid, the resulting precipitate was dried at 150° C. Thus, a carrier core material composed of ferrite particles from which the ultrafine powder bad been removed was obtained.

(2) Production of Carrier

Preparation of Resin Solution:

A carrier was produced by using the carrier core material thus obtained. First, a tetrafluoroethylene-hexafluoropropylene copolymer (FEP) and a polyamide imide resin (PAI) were dispersed in water so as to attain a mixing weight ratio (FEP/PAI) of 8/2 to obtain an undiluted resin solution. With 500 ml of water was diluted 100 g, in terms of a solid content, of the undiluted resin solution, and thereto was further added an appropriate amount of an ammonium polycarboxylate dispersant. The diluted resin solution containing the dispersant added was dispersed by using an ultrasonic homogenizer for 3 minutes and then further dispersed by using a bead mill (media diameter: 2 mm) for 10 minutes, to prepare a resin solution.

Formation of Resin-Coating Layer:

Next, a resin-coating layer was formed on a surface of the carrier core material by using the carrier core material and the resin solution. The amount of the carrier core material was 10 kg. A coating apparatus with fluidized bed was used for forming the resin-coating layer. Then, the resulting coated material was baked at 250° C. for one hour, thereby obtaining a carrier having the resin-coating layer on a surface of the carrier core material. The resin-coating amount was 1% by weight with respect to the carrier core material.

(3) Evaluation

As to the carrier core material and carrier obtained, evaluations of various characteristics were performed in the manner described below.

Evaluation using Laser Diffraction/Scattering Method:

Particle size distribution of the carrier core material was determined by using a laser diffraction/scattering method. First, into a 100 ml-beaker was put 10 g of sample (carrier core material) together with 80 ml of water as a dispersion medium and then, thereto was added a few drops of sodium hexametaphosphate as a dispersant. Then, dispersion was performed by using an ultrasonic homogenizer (UH-150 Model, manufactured by SMT Co., Ltd.) for 20 seconds by setting the output level to 4. Then, foams formed on a surface of the beaker ware removed, and the sample was loaded in a Microtrack particle size analyzer (Model 9320-X100, manufactured by Nikkiso Co., Ltd.) to perform is analysis. From the analysis results obtained, a volume average particle size ($D_{50}$), a ratio of particles less than 20 μm in volume distribution ($Pv_{(d<20)}$), a ratio of particles of less than 16 μm in volume distribution ($Pv_{(d<16)}$), and a ratio of particles of less than 16 μm in number distribution ($Pn_{(d<16)}$) were determined, respectively.

Evaluation using Mesh Passing Amount:

A mesh-passing amount ($Pw_{(d<16)}$) of the carrier core material was calculated from the weights before and after mesh passage. First, a dedicated cell with a stainless mesh having an opening of 16 μm (SV-Sieve SV-16/16tw, manufactured by Asada Mesh Co., Ltd.) was prepared. A sample (carrier core material) of 2,5000±0.0005 g was weighed out (this is referred to as input amount A) and put into the dedicated cell, and weight B of the dedicated cell containing the sample was measured. Subsequently, the dedicated cell containing the sample was set in a suction-type charge amount measuring apparatus (q/m meter, manufactured by Epping Gmbh), and suction was performed at a suction pressure of 105±5 mbar for 90 seconds. Thereafter, the dedicated cell was removed, and weight C of the dedicated cell containing the sample after the suction was measured. Then, the mesh-passing amount ($Pw_{(d<16)}$) was determined based on equation (2): Mesh-passing amount (% by weight)=(weight B−weight C)/input amount A×100.

Evaluation using Particle Size/Shape Distribution Measuring Instrument:

Particle size/shape distribution of the carrier core material, was determined by image analysis. First, an aqueous xanthan gum solution having a viscosity of 0.5 Pa·s was prepared as a dispersion medium. In 30 ml of the aqueous xanthan gum solution was dispersed 0.1 g of a sample (carrier core material) to prepare a sample liquid. By properly adjusting the viscosity of the dispersion medium as above, the condition in which the sample is still dispersed in the dispersion medium can be maintained as it is so that the measurement can be smoothly performed.

Next, 3,000 particles in the sample, liquid were observed by using a particle size/shape distribution measuring instrument (PITA-1, manufactured by Seishin Enterprise Co., Ltd.), and a number average particle size (average equivalent circle diameter) and a number frequency of particles of less than 16 μm ($Pm_{(d<16)}$) were determined by using the software (Image Analysis) included with the instrument. In the measurement, magnification of (objective) lens was set to 10 times, and the used filter was ND4×2. Furthermore, as carrier liquid 1 and carrier liquid 2, an aqueous xanthan gum solution having a viscosity of 0.5 Pa·s was used, and the flow rates thereof were set to 10 μl/second. The flow rate of the sample liquid was set to 0.08 μl/second. Moreover, in the image analysis, a binarization processing was performed by setting the binarized level for determining the particles to be captured to 80 and setting the binarized level for determining the contour of the captured particles to 200.

Evaluation using SEM Image:

Shape factor SF-1 of the carrier core material was determined by the analysis using scanning electron microscope (SEM) images. First, by using a field emission type scanning electron Microscope (FE-SEM, SU8020, manufactured by Hitachi High-Technologies Corp.), particles in the sample (carrier core material) were photographed at a view field of 450 magnification. The image information obtained was fed via an interface into an image analyzing software (Image-Pro PLUS, manufactured by Media Cybernetics Inc.) to perform analysis, thereby determining a projected area (S) and a Feret diameter (R).

Next, the shape factor ST-1 of each of the particles was calculated according to equation (3): $SF\text{-}1=(R^2/S)\times(\pi/4)\times 100$. The same operation was performed as to 100 particles, and an average value of SF-1 for 100 particles was taken as the shape factor SF-1 of the carrier core material.

Apparent Density:

The apparent density (AD) of the carrier core material was measured in accordance with JIS Z 2504 (Test Method for Apparent Density of Metal Powders).

BET Specific Surface Area:

The BET specific surface area of the carrier core material was measured in the manner described below. First, a sample (carrier core material) was placed in a vacuum drier, treated at 200° C. for 2 hours, and held in the dryer until the temperature reached 80° C. or below. The sample was took out of the dryer and then, filled densely in a cell, and the cell was set in a BET specific surface area measurement device (Macsorb HM model 1210, manufactured by Mountech Co., Ltd.). After performing a pre-treatment at a deaeration temperature of 200° C. for 60 minutes, the measurement was conducted.

Supernatant Transmittance:

The supernatant transmittance of the carrier core material was measured in the manner described below. First, into a 50 ml-glass bottle were put 15 g of a sample (carrier core material) and 25 g of methanol. Next, the bottle containing the sample was shaken for 20 minutes at a shaking strength of 200 times/minute by using a shaker (Model-YS-LD, manufactured by Yayoi Co., Ltd.), followed by allowing to stand for one minute and then, a supernatant liquid was recovered. An absorption spectrum of the recovered supernatant liquid was determined by using a spectrophotometer (UV-1800, manufactured by Shimadzu Corp.) and the transmittance at a wavelength of 400 nm was taken as the supernatant transmittance.

Migration Amount of Ultrafine Powder:

The migration amount of ultrafine powder of the carrier core material and carrier was measured in the manner described below. First, a sample (carrier core material or carrier) and a cyan toner (for use in DocuPrint C3530, manufactured by Fuji Xerox Co., Ltd.) that is a toner with negative polarity used for full-color printers were weighed so as to attain a toner concentration of 1.0% by weight and the total weight of 30 g. The sample and toner weighed were placed in a 50 ml-plastic bottle, and stirred at a stirring speed of 96 rpm for one hour by using a stirrer (Turbula Mixer Model T2C, manufactured by Turbula Co.) to form a developer.

As a device for separating the sample and the toner, a device composed of a cylindrical aluminum bare tube (sleeve), a magnet roll arranged on an inside of the sleeve and an cylindrical electrode arranged so as to surround an outside of the sleeve was used. The sleeve had a diameter of 31 mm and a length of 76 mm. The magnet roll had a structure in which a total of 8 poles of magnets (magnetic flux density, 0.1 T) were arranged such that N poles and S poles were alternatively arranged. The cylindrical sleeve and the cylindrical electrode were placed with a gap there between of 5.0 mm.

On the sleeve of the separation device was uniformly adhered 0.5 g of the developer. Next, under the conditions where the magnet roll on the inside was rotated at a rotational speed of 100 rpm, with the sleeve being fixed, a direct current voltage of 2,000 V was applied between the electrode on the outside and the sleeve for 60 seconds. When the voltage was applied, the toner in the developer was migrated to the electrode on the outside. After the lapse of 60 seconds, the voltage applied was shut off. The rotation of the magnet roll was stopped, the electrode on the outside was taken out, and the toner migrated to the electrode was recovered.

As to each of the toner used for preparing the developer and the toner recovered, the amounts of the elements present on a surface of the toner were measured by a fluorescent X-ray elemental analysis and the amount of ultrafine powder migrated from the sample (carrier core material or carrier) to the toner was evaluated. First, the toner was uniformly adhered on a sheet of polyester film having an adhesive coated thereon, to prepare a sample for measurement, and the sample for measurement was set on a sample stand. Next, elemental analysis was performed by a scanning fluorescence X-ray analyzer (ZSX Primus II, manufactured by Rigaku Corp.) by using EZ scan which was a contained element scanning function.

From the analysis results, a total amount ($A_M$) of weight, percentages of iron (Fe) and the M components (Mn, Mg, Sr and Zr) of, the semi-quantitative values of the toner used for preparing the developer, a total amount ($B_M$) of weight percentages of iron and the M components of the semi-quantitative values of the toner recovered by separating from the developer, and a value ($B_C$) of weight percentage of carbon (C) of the semi-quantitative values of the toner recovered by separating from the developer were determined. The migration amount was calculated according to equation (4): Migration amount=$(B_M-A_M)/B_C$.

Example 2

(1) Production of Carrier Core Material

Mix and Pulverization of Raw Materials:

Raw materials were weighed so as to attain a composition ratio after sintering of 39.6% by mole of MnO, 9.6% by mole of MgO, 50.0% by mole of $Fe_2O_3$ and 0.8% by mole of SrO. At that time, as the raw materials, 34.2 kg of iron oxide ($Fe_2O_3$), 12.9 kg of trimanganese tetraoxide ($Mn_3O_4$), 2.4 kg of magnesium hydroxide ($Mg(OH)_2$), and 0.5 kg of strontium carbonate ($Sr(CO_3)$ were used. The raw materials weighed were mixed and pulverized for 5 hours by using a dry media mill (vibration mill, ⅛ inch diameter stainless steel beads), to prepare a raw material mixture.

Calcination:

The resulting raw material mixture was calcined. First, the raw material mixture was made into pellets of about mm-cube by using a roller compactor. From the resulting pellets, coarse particles were removed by using a vibration screen having an opening of 3 mm and then fine particles were removed by using a vibration screen having an opening of 0.5 mm. The pellets after removing the coarse particles and the fine particles were heated at 1,200° C. for 3 hours by using a continuous electric furnace, to prepare a calcined product.

Pulverization and Granulation:

The resulting calcined product was pulverized for 6 hours by using a dry media mill (vibration mill, ⅛ inch diameter stainless steel beads), water was added thereto, and further pulverized for 8 hours by using a wet media mill (horizontal head mill, 1 mm diameter zirconia heads), to form a slurry. To the resulting slurry was added polyvinyl alcohol (PVA, 10% by weight solution) as a binder in an amount of 0.4% by weight with respect to the calcined product, and thereto was further added a polycarboxylic acid dispersant to adjust a slurry viscosity to 2 poise.

Next, the slurry after adjusting the viscosity was granulated and dried by using a spray drier. At that time, the conditions were set so, as to attain an average particle size of the sintered product after sintering being 30 μm. The particle size of the resulting granulated product was adjusted by using a gyro shifter and then, the granulated product after the particle size adjustment was heated at 750° C. for 2 hours by using a rotary electric furnace under atmospheric conditions to remove organic components such as the dispersant and the binder, Sintering:

The granulated product after removing the organic components was sintered by using a tunnel electric furnace to prepare a sintered product. The sintering was performed by holding the granulated product at a sintering temperature of 1,190° C. for 5 hours in an atmosphere having an oxygen concentration of 0.7% by volume. The temperature rising rate was set to 150° C./hour and the temperature drop rate was set, to 110° C./hour. Furthermore, nitrogen gas was introduced to the electric furnace from its outlet side, and the internal pressure of the electric furnace was set to from 0 to 10 Pa (positive pressure). The resulting sintered product was disaggregated by using a hammer crusher and then, coarse particles were removed by using a gyro shifter equipped with a screen mesh of 400 mesh. The sintered product after removing coarse particles was subjected to a particle size adjustment of removing fine particles by using a precision air classifier (Turbo Classifier TC-15, manufactured by Nissin Engineering Inc.) under conditions of 1,500 rpm. Low magnetic force products were removed by magnetic separation from the sintered product after the particle size adjustment, to obtain ferrite particles.

Removal of Ultrafine Powder:

Ultrafine powder was further removed from the ferrite particles (sintered product) after removing low magnetic force products. First, the ferrite particles were mixed with propylene glycol to prepare a slurry of ferrite particle having a solid content concentration of 30% by weight. Next, the resulting slurry was subjected to a dispersion treatment for one minute by using a thin-film spin system high-speed mixer (FILMIX, manufactured by PRIMIX Corp.) under conditions of 30 m/second. The slurry after the dispersion treatment was allowed to stand for one minute to separate into a precipitate and a supernatant liquid. After removing the supernatant liquid, the resulting precipitate was dried at 1.50° C. Thus, a carrier core material composed of ferrite particles from which the ultrafine powder had been removed was obtained.

(2) Production of Carrier

Preparation of Resin Solution:

A carrier was produced by using the carrier core material thus obtained. First, a tetrafluoroethylene-hexafluoropropylene copolymer (IEP) and a polyamide imide resin (PAI) were dispersed in water so as to attain a mixing weight ratio (FEP/PAI) of 8/2 to obtain an undiluted resin solution. With 500 ml of water was diluted 200 g, in terms of a solid content, of the undiluted resin solution, and thereto were further added 20 g (10% by weight with respect to the resin solid content) of carbon black (EC600JD, manufactured by Ketjenblack International Co., Ltd.) and an appropriate amount of an ammonium polycarboxylate dispersant. The diluted resin solution containing the carbon black and dispersant added was dispersed by using an ultrasonic homogenizer for 3 minutes and then further dispersed by using a bead mill (media diameter: 2 mm) for 10 minutes, to prepare a resin solution.

Formation of Resin-Coating Layer:

Next, a resin-coating layer was formed on a surface of the carrier core material by using the carrier core material and the resin solution. The amount of the carrier core material was 10 kg. A coating apparatus with fluidized bed was used for forming the resin-coating layer. Then, the resulting coating material was baked at 250° C. for one hour, thereby obtaining a carrier having the resin-coating layer on a surface of the carrier core material. The resin-coating amount was 2% by weight with respect to the carrier core material.

(3) Evaluation

As to the carrier core material and carrier obtained, the evaluations were performed in the same manner as in Example 1.

Example 3

(1) Production of Carrier Core Material

Mix and Pulverization of Raw Materials:

Raw materials were weighed so as to attain a condition ratio after sintering of 38.0% by mole of MnO, 11.0% by mole of MgO, 50.3% by mole of $Fe_2O_3$, and 0.7% by mole of SrO. At that time, as the raw materials, 17.2 kg of iron oxide ($Fe_2O_3$), 6.2 kg of trimanganese tetraoxide ($Mn_3O_4$), 1.4 kg of magnesium hydroxide ($Mg(OH)_2$), and 0.2 kg of strontium carbonate ($SiCO_3$) were used. Next, the raw materials weighed were mixed and pulverized for 4.5 hours by using, a dry media mill (vibration mill, ⅛ inch diameter stainless steel beads), to prepare a raw material mixture.

Calcination:

The resulting raw material mixture was calcined. First, the raw material mixture was made into pellets of about 1 mm-cube by using a roller compactor. From the resulting pellets, coarse particles were removed by using a vibration screen having an opening of 3 mm and then fine particles were removed by using a vibration screen having an opening of 0.5 mm. The pellets after removing the coarse particles and the line particles were heated at 1,080° C. for 3 hours by using a rotary electric furnace, to prepare a calcined product.

Pulverization and Granulation:

The resulting calcined product was pulverized by using a dry media mill (vibration mill. ⅛ inch diameter stainless steel beads), water was added thereto, and further pulverized for 10 hours by using a wet media mill (horizontal bead mill, 1/16 inch diameter stainless steel beads), to form a slurry. To the resulting slurry was added polyvinyl alcohol (PVA, 20% by weight solution) as a binder in an amount of 0.2% by weight with respect to the calcined product, and thereto was further added a polycarboxylic acid dispersant to adjust a slurry viscosity to 2 poise.

Next, the slurry after adjusting the viscosity was granulated and dried by using a spray drier. At that time, the conditions were set so as to attain an average particle size of the sintered product after sintering being 40 μm. The particle size of the resulting granulated product was adjusted by using a gyro shifter and then, the granulated product after the particle size adjustment was heated at 700° C. for 2 hours by using a rotary electric furnace to remove organic components such as the dispersant and the binder.

Sintering:

The granulated product after removing the organic components, was sintered by using a tunnel electric furnace to prepare a sintered product. The sintering was performed by holding the granulated product at a sintering temperature of 1,098° C. for 5 hours in an atmosphere having an oxygen concentration of 0.8% by volume. The temperature rising rate was set to 150° C./hour and the temperature drop rate was set to 110° C./hour. Furthermore, nitrogen gas was introduced to the electric furnace from its outlet side, and the internal pressure of the electric furnace was set to from 0 to 10 Pa (positive pressure). The resulting sintered product was disaggregated by using a hammer crusher and then, coarse particles were removed by using a gyro shifter, equipped with a screen mesh of 300 mesh. The sintered product after removing coarse particles was subjected to a particle size adjustment of removing fine particles by using a precision air classifier (Turbo Classifier TC-15, manufactured by Nissin Engineering Inc.) under conditions of 1,400 rpm. Low magnetic force products were removed by magnetic separation from the sintered product after the particle size adjustment, to obtain ferrite particles. The resulting ferrite particles were porous.

Removal of Ultra Fine Powder:

Ultrafine powder was further removed from the ferrite particles (sintered product) after removing low magnetic three products. The removal of ultrafine powder was performed by subjecting the ferrite particles to a classification processing using a precision air classifier (Turbo Classifier TC-15, manufactured by Nissin Engineering Inc.). The rotational speed of the classifier was set to 4,000 rpm. Thus, a carrier core material composed of porous ferrite particles from which the ultrafine powder had been removed was obtained.

(2) Production of Carrier

Preparation of Filling Resin Solution:

A carrier was produce by filling a resin in pores of the carrier core material (porous ferrite particles) thus obtained. First, to 30 parts by weight of a methylsilicone resin solution (6 parts by weight as a solid content because of the concentration of the resin solution being 20%) was added titanium diisopropoxybis(ethylacetoacetate) as a catalyst in an amount of 25% by weight (3% by weight in terms of titanium atom) with respect to the resin solid content. Then, to the mixture was further added 3-aminopropyltriethoxysilane as an aminosilane coupling agent in an amount of 5% by weight with respect to the resin solid content, to prepare a filling resin solution.

Filling of Resin Solution:

Next, the carrier core material (porous ferrite particles) and the filling resin solution (dilution solvent: toluene) were placed in a filling apparatus, and mixed and stirred at 60° C. under a reduced pressure of 6.7 kPa (about 50 mmHg), to thereby make the resin solution penetrate and till into the pores of the carrier core material while volatilizing toluene. At that time, 30 parts by weight (6 parts by weight in terms of solid content) of the methylsilicone resin solution was used with respect to 100 parts by weight of the carrier core material. The pressure in the filling apparatus was returned to normal pressure, toluene was almost completely removed while continuing stirring at normal pressure, and the carrier core material was taken out of the filling apparatus. The carrier core material was placed in a vessel and subjected to a heat treatment at 220° C. for 1.5 hours by using a hot air oven. After cooling to room temperature, the carrier core material in which the resin had been filled and cured was taken out. The aggregation of the carrier core material (carrier particles) was disaggregated through a vibration screen having an opening of 200 mesh. Thereafter, non-magnetic substances were removed by using a magnetic separation machine. Thus, the carrier in which the resin had been filled in pores of the carrier core material (porous ferrite particles) was obtained. The filling amount of the resin was 6% by weight with respect to the carrier core material.

(3) Evaluation

As to the carrier core material and carrier obtained, the evaluations were performed in the same manner as in Example 1.

Example 4

(1) Production of Carrier Core Material

Mix and Pulverization of Raw Materials:

Raw materials were weighed, so as to attain a composition ratio after sintering of 40.0% by mole of MnO, 10.0% by mole of MgO and 50.0% by mole of $Fe_2O_3$, and further 1.5 parts by weight of $ZrO_2$ was added thereto with respect to 100 pars by weight of these metal oxides. At that time, as the raw materials, 16.9 kg of iron oxide ($Fe_2O_3$), 6.5 kg of trimanganese tetraoxide ($Mn_3O_4$), 1.2 kg of magnesium hydroxide ($Mg(OH)_2$), and 0.4 kg of zirconium oxide ($ZrO_2$)

were used, respectively. The raw materials weighed were pulverized and mixed for 5 hours by using a wet ball mill, and further dried by a spray dryer, to prepare a raw material mixture.

Calcination:

The resulting raw material mixture was calcined. The calcination was performed by holding the raw material mixture at 950° C. for one hour, to prepare a calcined product.

Pulverization and Granulation;

Water was added to the resulting calcined product, and the mixture was pulverized for 6 hours by using a wet ball mill to form a slurry. To the resulting slurry was added polyvinyl alcohol (PVA, 20% by weight solution) as a hinder in an amount of 0.2% by weight with respect to the calcined product, and thereto was further added a polycarboxylic acid dispersant to adjust a slurry viscosity to 2 poise.

Next, the slurry after adjusting the viscosity was granulated and dried by using a spray drier. At that time, the conditions were set so as to attain an average particle size of the sintered product after sintering being 35 μm. The resulting granulated product was heated at 650° C. under atmospheric conditions to remove organic components such as the dispersant and the binder.

Sintering:

The granulated product after removing the organic components was sintered by using a tunnel electric furnace to prepare a sintered product. The sintering was performed by holding the granulated product at a sintering temperature of 1,250° C. for 6 hours in an atmosphere having an oxygen concentration of 0.3% by volume. The temperature rising rate, was set to 150° C./hour and the temperature drop rate was set to 110° C./hour. Furthermore, nitrogen gas was introduced to the electric furnace from its outlet side, and the internal pressure of the electric furnace was set to from 0 to 10 Pa (positive pressure). The resulting sintered product was disaggregated by using a hammer crusher and then, coarse particles were removed by using a gyro shifter equipped with a screen mesh of 350 mesh. The sintered product after removing coarse particles was subjected to a particle size adjustment of removing fine particles by using a precision air classifier (Turbo Classifier TC-15, manufactured by Nissin Engineering Inc) under conditions of 1,200 rpm. Low magnetic force products were removed by magnetic separation from the sintered product after the particle size adjustment, to obtain ferrite particles.

Removal of Ultrafine Powder:

Ultrafine powder was further removed from the ferrite particles (sintered product) after removing low magnetic force products. The removal of ultrafine powder was performed by subjecting the ferrite particles to a classification processing using a precision air classifier (Turbo Classifier TC-15, manufactured by Nissin Engineering Inc.). The rotational speed of the classifier was set to 8,000 rpm. Thus, ferrite particles from which the ultrafine powder had been removed were obtained.

Oxide Film Treatment:

The ferrite particles after removing the ultrafine powder were subjected to an oxide film treatment by holding the ferrite particles at 500° C. for one hour by using, a rotary atmospheric furnace. The ferrite particles subjected to the oxide film treatment were subjected to a magnetic separation and mixed, to thereby obtain a carrier core material.

(2) Production of Carrier

Preparation of Resin Solution:

A carrier was produced by using the carrier core material thus obtained. First, to 5 parts by weight of a methylsilicone resin solution (1 part by weight as a solid content because of the concentration of the resin solution being 20%) was added titanium diisopropoxybis(ethylacetoacetate) as a catalyst in an amount of 25% by weight (3% by weight in terms of titanium atom) with respect to the resin solid content. Then to the mixture was further added 3-aminopropyltriethoxysilane as an aminosilane coupling agent in an amount of 5% by weight with respect to the resin solid content, and was further added carbon black (Mogul L, manufactured by Cabot Corp.) as a conductor in an amount of 3% by weight with respect to the resin, to prepare a resin solution.

Formation of Resin-Coating Layer:

Next, a resin-coating layer was formed on a surface of the carrier core material by using the carrier core material and the resin solution (dilution solvent: toluene). The formation of the resin-coating layer was performed in the following manner. The carrier core material, and the resin solution were mixed and stirred by using a universal mixer and the surface of the carrier core material was coated by the silicone resin while volatilizing toluene. At that time, 5 parts by weight (one part by weight in, terms of solid content) of the methylsilicone resin solution was used with respect to 100 parts by weight of the carrier core material. After confirming that the toluene was thoroughly volatilized, the carrier core material coated was taken out of the apparatus. The carrier core material was placed in a vessel and subjected to a heat treatment at 220° C. for 2 hours by using a hot air oven. After cooling to room temperature, the carrier core material on which the resin had been coated and cured was taken out. The aggregation of the carrier core material (carrier particles) was disaggregated through a vibration screen having an opening of 250 mesh. Thereafter, non-magnetic substances were removed by using a magnetic separation machine, and coarse particles were again removed by using a vibration screen having an opening of 250 mesh. Thus, the carrier in which the resin-coating layer had, been provided on a surface of the carrier core material was obtained. The coating amount of the resin was 1% by weight with respect to the carrier core material.

(3) Evaluation

As to the carrier core material and carrier obtained, the evaluations were performed in the same manner as in Example 1.

Example 5 (Comparative Example)

The production of carrier core material and carrier and the evaluations thereof were performed in the same manner as in Example 1 except that the removal of ultrafine powder was not performed in the production of the carrier core material.

Example 6 (Comparative Example)

The production of carrier core material and carrier and the evaluations thereof were performed in the same manner as in Example 2 except that the removal of ultrafine powder was not performed in the production of the carrier core material.

Example 7 (Comparative Example)

The production of carrier core material and carrier and the evaluations thereof were, performed in the same manner a in Example 3 except that the removal of ultrafine powder was not performed in the production of the carrier core material.

Example 8 (Comparative Example)

The production of carrier core; material and carrier and the evaluations thereof were performed in the same manner as in Example 4 except that the removal of ultrafine powder was not performed in the production of the carrier core material.

Results:

The evaluation results obtained in Examples 1 to 8 were as shown in Table 1. In Examples 1 to 4, which are Inventive Examples, the supernatant transmittances of the carrier core materials were as high as 91.6% or more. Furthermore, the carriers produced from those carrier core materials had a migration amount of ultrafine powder as low as 412 ppm or less. From these results, it has been found that in these carrier core materials of Examples 1 to 4, the amount of ferrite ultrafine powder adhering to the surfaces thereof is small and thus, when the carrier is produced, the migration of the ultrafine powder to a toner is suppressed. In particular, in Examples 1 and 2 in which the removal of ultrafine powder was performed by a wet process, the supernatant transmittances of the carrier core materials were 96.7% or more and the migration amounts of ultrafine powder of the carrier were as very low as 135 ppm or less. Therefore, it has been found that the removal of ultrafine powder by a wet process is very excellent in the effect of preventing the migration of ultrafine powder to a toner.

On the contrary, in Examples 5 to 8, which are Comparative Examples, the supernatant transmittances of the carrier core materials were 84.7% or less, and the migration amounts of ultrafine powder of the carriers were as high as 666 ppm or more. For example, Example 5 is different from Example 1 only by the presence or absence of the removing step of ultrafine powder and others are the same in the production of the carrier core material. However, the migration amount of ultrafine powder of the carrier in Example 5 is 666 ppm, which is more than 6 times of the migration amount of ultrafine powder (107 ppm) in Example 1. From these results, it has been found that these carrier core materials of Examples 5 to 8 are poor in the effect of preventing the migration of ultrafine powder to a toner.

The relationship between the supernatant transmittance of a carrier core material and the migration amount of ultrafine powder of a carrier in Examples 1 to 8 is shown in FIG. 1. As is apparent from FIG. 1, there is a strong correlation between the supernatant transmittance of a carrier core material and the migration amount of ultrafine powder of a carrier, and the higher the supernatant transmittance, the smaller the migration amount of ultrafine powder. From this result, it has been found that the supernatant transmittance of a carrier core material is an excellent indicator of the migration amount of ferrite ultrafine powder.

On the contrary, the laser diffraction/scattering method, mesh passing amount, particle size/shape distribution measuring instrument, or SEM image could not accurately evaluate the amount of ferrite ultrafine powder (migration amount of ferrite ultrafine powder). In fact, as is apparent from Table 1, the evaluation results ($D_{50}$, $Pv_{(d<20)}$, $Pv_{(d<16)}$, $Pw_{(d<16)}$, SF-1, average equivalent circle diameter, $Pm_{(d<16)}$,) by the laser diffraction/scattering method, mesh passing amount, particle size/shape distribution measuring instrument, or SEM image were found not to have a correlation with the migration amount of ultrafine powder.

TABLE 1

| | Carrier Core Material | | | | | | | | | | | | Carrier |
|---|---|---|---|---|---|---|---|---|---|---|---|---|---|
| | Laser Diffraction/Scattering Method | | | | | | Image Analysis | | | | | Migration | Migration |
| | Volume Distribution $D_{50}$ (μm) | Volume Distribution $Pv_{(d<20)}$ (%) | Volume Distribution $Pv_{(d<16)}$ (%) | Number Distribution $Pn_{(d<16)}$ (%) | Mesh Passing Amount $Pw_{(d<16)}$ (wt %) | SEM SF-1 | Average Equivalent Circle Diameter (μm) | Number Distribution $Pm_{(d<16)}$ (%) | AD (g/cm$^3$) | BET (m$^2$/g) | Supernatant Transmittance (%) | Amount of Ultrafine Powder (ppm) | Amount of Ultrafine Powder (ppm) |
| Ex. 1 | 35.7 | 0.4 | 0.0 | 0.0 | 0.18 | 128 | 37.7 | 0.9 | 2.25 | 0.10 | 97.9 | 216 | 107 |
| Ex. 2 | 32.8 | 1.3 | 0.0 | 0.0 | 0.12 | 117 | 35.1 | 1.2 | 2.14 | 0.15 | 96.7 | 334 | 135 |
| Ex. 3 | 42.2 | 0.0 | 0.0 | 0.0 | 0.02 | 121 | 44.1 | 3.3 | 2.01 | 0.34 | 93.2 | 569 | 412 |
| Ex. 4 | 37.2 | 0.1 | 0.0 | 0.0 | 0.08 | 126 | 39.6 | 0.6 | 2.35 | 0.07 | 91.6 | 703 | 289 |
| Ex. 5* | 35.6 | 0.4 | 0.0 | 0.0 | 0.19 | 128 | 37.5 | 0.9 | 2.25 | 0.10 | 84.7 | 1377 | 666 |
| Ex. 6* | 32.7 | 1.3 | 0.0 | 0.0 | 0.14 | 118 | 35.2 | 1.0 | 2.14 | 0.15 | 82.3 | 1837 | 698 |
| Ex. 7* | 42.4 | 0.0 | 0.0 | 0.0 | 0.01 | 121 | 44.3 | 3.4 | 2.00 | 0.34 | 80.4 | 2008 | 1428 |
| Ex. 8* | 37.2 | 0.2 | 0.0 | 0.0 | 0.08 | 125 | 39.5 | 0.7 | 2.36 | 0.08 | 84.1 | 1410 | 701 |

Note:
*indicates Comparative Example.

While the present invention has been described with reference to certain exemplary embodiments thereof, the scope of the present invention is not limited to the exemplary embodiments described above, and it will be appreciated by those skilled in the art that various changes and modifications may be made therein without departing from the scope of the present invention as defined by the appended claims.

The present application is based on Japanese Patent Application No. 2019-011440 filed on Jan. 25, 2019, the contents thereof being hereby incorporated by reference.

The invention claimed is:

1. A carrier core material for an electrophotographic developer, comprising a ferrite composition having a transition metal oxide as a main component, wherein an amount of an ultrafine powder contaminant adhering to a surface of the carrier core material is attenuated by determining the transmittance with a spectrophotometer of a supernatant separated from the ultrafine powder.

2. The carrier core material according to claim 1, having an apparent density of from 1.5 to 2.5 g/cm$^3$.

3. The carrier core material according to claim 1, having a volume average particle diameter $D_{50}$ of from 20 to 50 μm.

4. The carrier core material according to claim 1, having a shape factor SF-1 of from 105 to 150.

5. The carrier core material according to claim 1, having a BET specific surface area of from 0.05 to 0.55 $m^2/g$.

6. The carrier core material according to claim 1, having an average equivalent circle diameter of from 20 to 50 μm.

7. The carrier core material according to claim 1, wherein the ferrite composition is represented by formula (1): $(MO)_x(Fe_2O_3)_y$, wherein, x+y is 100% by mole, y is 30 to 95% by mole, and M is at least one element selected from the group consisting of Fe, Mn, Mg, Sr, Ca, Ti, Li, Al, Si, Zr, and Bi.

8. A method for producing the carrier core material as described in claim 1, comprising:

mixing and pulverizing raw materials of the carrier core material to form a raw material mixture;

calcining the raw material mixture to form a calcined product;

pulverizing and granulating the calcined product to form a granulated product;

sintering the granulated product to form a sintered product; and removing ultrafine powder from the sintered product.

9. The method according to claim 8, wherein in the step of removing ultrafine powder, the sintered product is mixed to and dispersed in a solvent to from a slurry, the slurry is allowed to stand to separate into a precipitate and a supernatant liquid, and after removing the supernatant liquid, the precipitate is recovered and dried.

10. A carrier for electrophotographic developer, comprising the carrier core material as described in claim 1.

11. The carrier according to claim 10, further comprising a resin coating layer provided on a surface of the carrier core material.

12. The carrier according to claim 10, wherein the carrier core material is composed of porous ferrite particles having pores, and the carrier further comprises a resin filled in the pores.

13. A developer comprising the carrier core material as described in claim 1 and a toner.

14. The developer according to claim 13, wherein the toner is a white toner or a clear toner.

15. The carrier core material according to claim 1, wherein the transition metal oxide is iron oxide ($Fe_2O_3$) or manganese oxide (MnO).

16. The carrier core material according to claim 1, wherein the ultrafine powder migrates to a toner and results in toner color contamination.

17. The carrier core material according to claim 16, wherein the toner is a white color toner or a clear toner.

18. The carrier core material according to claim 16, wherein migration of the ferrite ultrafine powder to a toner can be suppressed by restricting the supernatant transmittance of the carrier core material to a predetermined range.

19. The carrier core material according to claim 1, wherein the supernatant has a transmittance of 85.0% or more.

20. A method for attenuating toner color contamination, comprising:

separating a ferrite ultrafine powder contaminant adhering to a sintered ferrite carrier core product by means of a supernatant; and determining the transmittance of the supernatant with a spectrophotometer.

21. The method of claim 20, wherein the attenuating is preventing, reducing, suppressing, or controlling toner color contamination.

* * * * *